US005435483A

United States Patent [19]

Cox

[11] Patent Number: 5,435,483

[45] Date of Patent: Jul. 25, 1995

[54] RUBBER MAILBOX JACKETS

[76] Inventor: Catherine M. Cox, 3370 Fox Run Dr., Asheboro, N.C. 27203

[21] Appl. No.: 269,105

[22] Filed: Jun. 30, 1994

[51] Int. Cl.[6] ..... B65D 91/00

[52] U.S. Cl. ..... 232/38

[58] Field of Search ..... 232/17, 38, 39

[56] References Cited

U.S. PATENT DOCUMENTS

| | | | |
|---|---|---|---|
| 4,187,978 | 2/1980 | Dowker | 232/39 |
| 4,244,512 | 1/1981 | Wise | 232/38 |
| 4,368,842 | 1/1983 | DeLange | 232/39 |
| 4,813,595 | 3/1989 | Johns, Jr. et al. | 232/17 |
| 4,991,769 | 2/1991 | Todd | 232/17 |
| 5,035,356 | 7/1991 | Granger | 232/38 |
| 5,054,685 | 10/1991 | Roach | 232/38 |
| 5,178,321 | 1/1993 | Majewski | 232/17 |

*Primary Examiner*—Michael J. Milano

[57] ABSTRACT

A mail box jacket is fabricated of rubber and comprises a cover formed in a generally planar rectangular configuration with parallel long side edges and parallel front and rear edges. The cover includes coupling devices which are positioned upon the long side edges of the cover. In the inoperative orientation the cover lies in a flat planar configuration. In the operative orientation the cover is contoured to fit snugly around the exterior of a mailbox.

4 Claims, 3 Drawing Sheets

FIG. 1
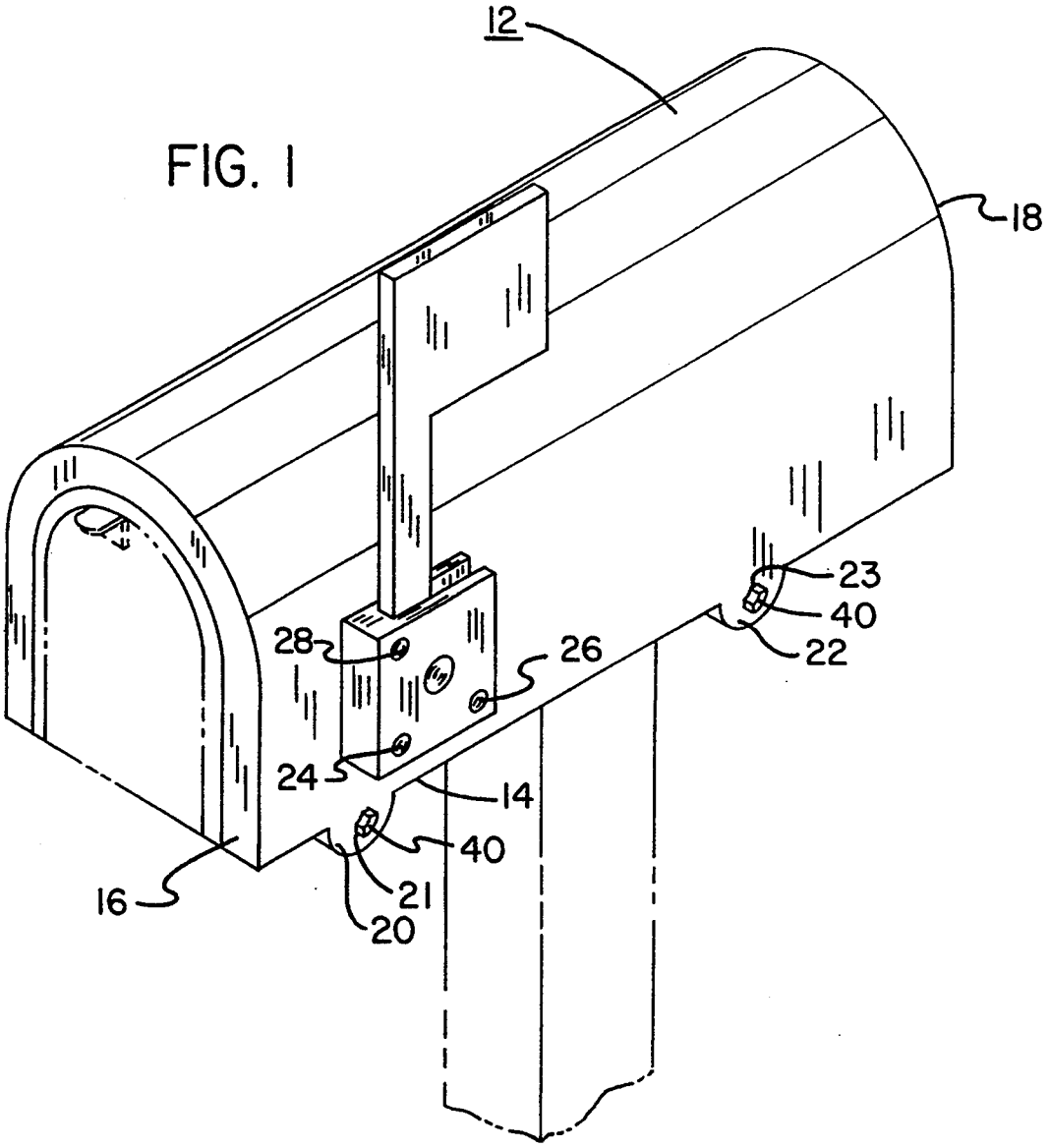
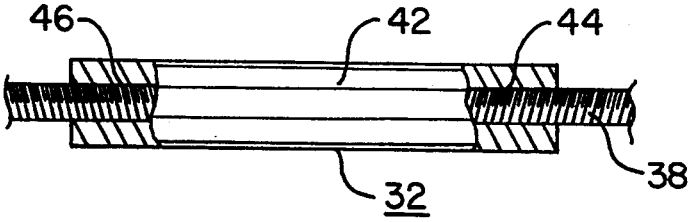
FIG. 6

RUBBER MAILBOX JACKETS

BACKGROUND OF THE INVENTION

1. Field of the Invention

The present invention relates to rubber mailbox jackets and more particularly pertains to protecting mailboxes from vandalism and harsh weather conditions.

2. Description of the Prior Art

The use of mailbox covers is known in the prior art. More specifically, mailbox covers heretofore devised and utilized for the purpose of providing decorative coverings for mailboxes are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,178,321 to Majewski a mailbox cover.

U.S. Pat. No. 5,106,016 to Beckman discloses a mailbox cover.

U.S. Pat. No. 5,035,356 to Granger discloses a mailbox cover structure.

U.S. Pat. No. Des. 287,899 to Lindheimer discloses a mailbox cover.

Lastly, U.S. Pat. No. Des. 305,824 to Carter discloses a mailbox cover.

In this respect, the rubber mailbox jackets according to the present invention substantially depart from the conventional concepts and designs of the prior art, and in doing so provide an apparatus primarily developed for the purpose of protecting mailboxes from vandalism and harsh weather conditions.

Therefore, it can be appreciated that there exists a continuing need for new and improved rubber mailbox jackets which can be used for protecting mailboxes from vandalism and harsh weather conditions. In this regard, the present invention substantially fulfills this need.

SUMMARY OF THE INVENTION

In view of the foregoing disadvantages inherent in the known types of mailbox covers now present in the prior art, the present invention provides improved rubber mailbox jackets. As such, the general purpose of the present invention, which will be described subsequently in greater detail, is to provide new and improved rubber mailbox jackets and method which has all the advantages of the prior art and none of the disadvantages.

To attain this, the present invention essentially comprises a new and improved mail box jacket including a cover fabricated of rubber and formed in a generally planar rectangular configuration with parallel long side edges and a parallel front and rear edge. Each long side edge includes two generally semi-circular shaped projections with holes which extend therethrough. A first projection is positioned a short distance from each front edge. A second projection is positioned equidistantly between each rear edge and the approximate midpoint of each long side edge. Three screw holes are positioned adjacent to the first semi-circular projection on one of the long side edges of the cover. The first screw hole is positioned a short distance from the first projection. The second screw hole is positioned rearwardly with respect to the first screw hole in a direction parallel to the plane of the long side edge. The third screw hole is positioned closer to the opposite long side edge, with respect to the first screw hole, in a direction parallel to the plane of the front edge. In the inoperative orientation the cover lies in a flat planar configuration. In the operative orientation the cover is contoured to fit snugly around the exterior of a generally semi-spherical shaped mailbox. The projections on the long side edges of the cover are positioned beneath the bottom of a mailbox opposing each other in the operative orientation. The screw holes in the cover are adapted to permit the positioning of a mailbox flag thereupon. The coupling screws of the flag are positioned through the holes and into the mailbox. The rubber cover is adapted to protect the mailbox from vandalism and harsh weather conditions. Two coupling devices each consist of two bolts and a connection rod. Each bolt is formed in a long solid, generally cylindrical configuration with a plurality of external screw threads throughout its extent. Each bolt has a planar, generally hexagon shaped head at one of its ends. Each connection rod is formed in a long, generally cylindrical configuration with a larger outer diameter than the bolts. The axis of the connection rod includes an aperture which extends its entire length. The aperture includes a plurality of internal screw threads. In the operative orientation each bolt is positioned through one of the holes in the semi-circular projections of the cover with each screw head extending outwardly. The free ends of the opposing pairs of bolts are adapted to screw into the connecting rod in the operative orientation. The coupling devices are positioned beneath the bottom of the mailbox and are adapted to tightly secure the cover therearound.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved rubber mailbox jackets which have all the advantages of the prior art mailbox covers and none of the disadvantages.

It is another object of the present invention to provide new and improved rubber mailbox jackets which may be easily and efficiently manufactured and marketed.

It is further object of the present invention to provide new and improved rubber mailbox jackets which are of durable and reliable constructions.

An even further object of the present invention is to provide new and improved rubber mailbox jackets which are susceptible of a low cost of manufacture with regard to both materials and labor, and which accordingly are then susceptible of low prices of sale to the consuming public, thereby making such rubber mailbox jackets economically available to the buying public.

Still yet another object of the present invention is to provide new and improved rubber mailbox jackets which provide in the apparatuses and methods of the prior art some of the advantages thereof, while simultaneously overcoming some of the disadvantages normally associated therewith.

Still another object of the present invention is to protect mailboxes from vandalism and harsh weather conditions.

Lastly, it is an object of the present invention to provide new and improved mail box jackets fabricated of rubber and comprised of a cover formed in a generally planar rectangular configuration with parallel long side edges and parallel front and rear edges. The cover includes coupling devices which are positioned upon the long side edges of the cover. In the inoperative orientation the cover lies in a flat planar configuration. In the operative orientation the cover is contoured to fit snugly around the exterior of a mailbox.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the rubber mailbox jacket constructed in accordance with the principles of the present invention.

FIG. 6 is a broken away perspective view of a coupling device component of the apparatus.

The same reference numerals refer to the same parts through the various Figures.

DESCRIPTION OF THE PREFERRED EMBODIMENT

Figure 2:
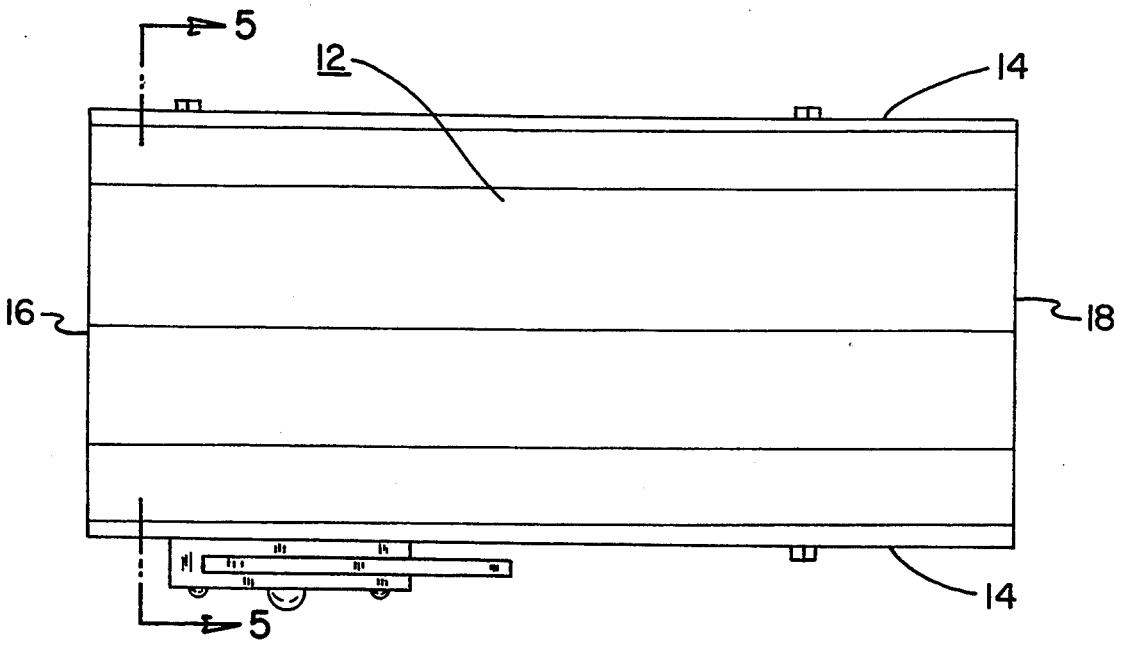
FIG. 2 is a top plan view of the rubber mailbox jacket in the operative orientation.

With reference now to the drawings, and in particular to FIG. 1 thereof, the preferred embodiment of the new and improved rubber mailbox jacket embodying the principles and concepts of the present invention and generally designated by the reference numeral 10 will be described.

Figure 3:
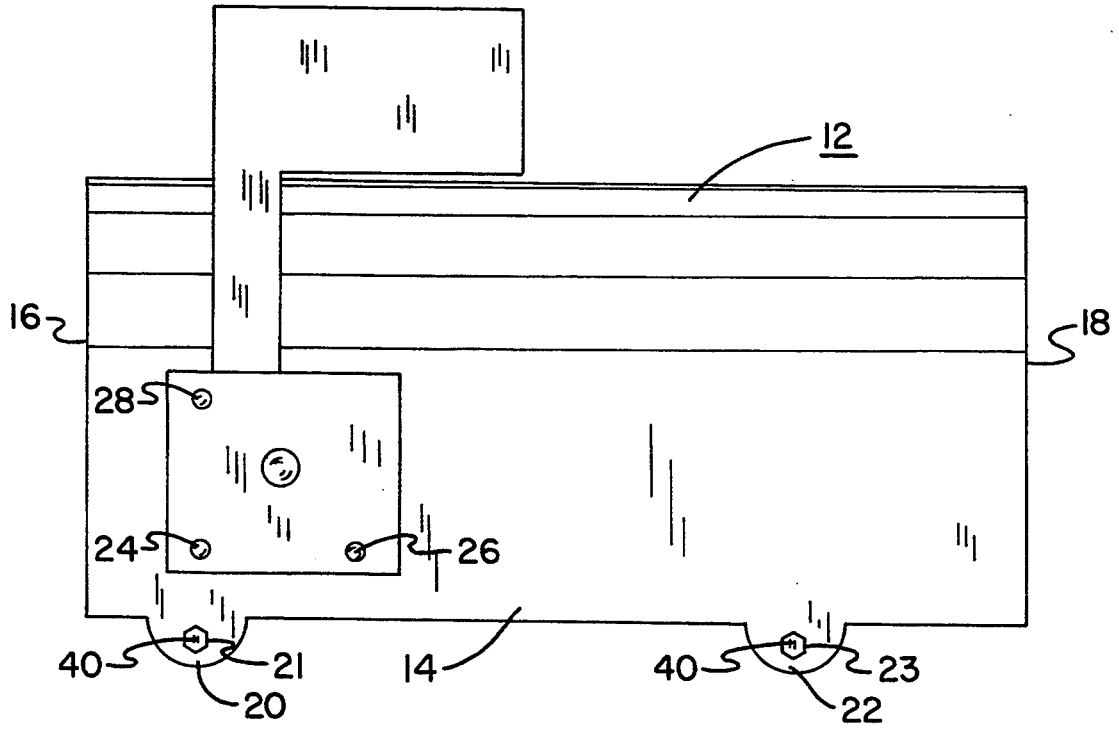
FIG. 3 is a side perspective view of the rubber mailbox jacket in the operative orientation.
Figure 4:
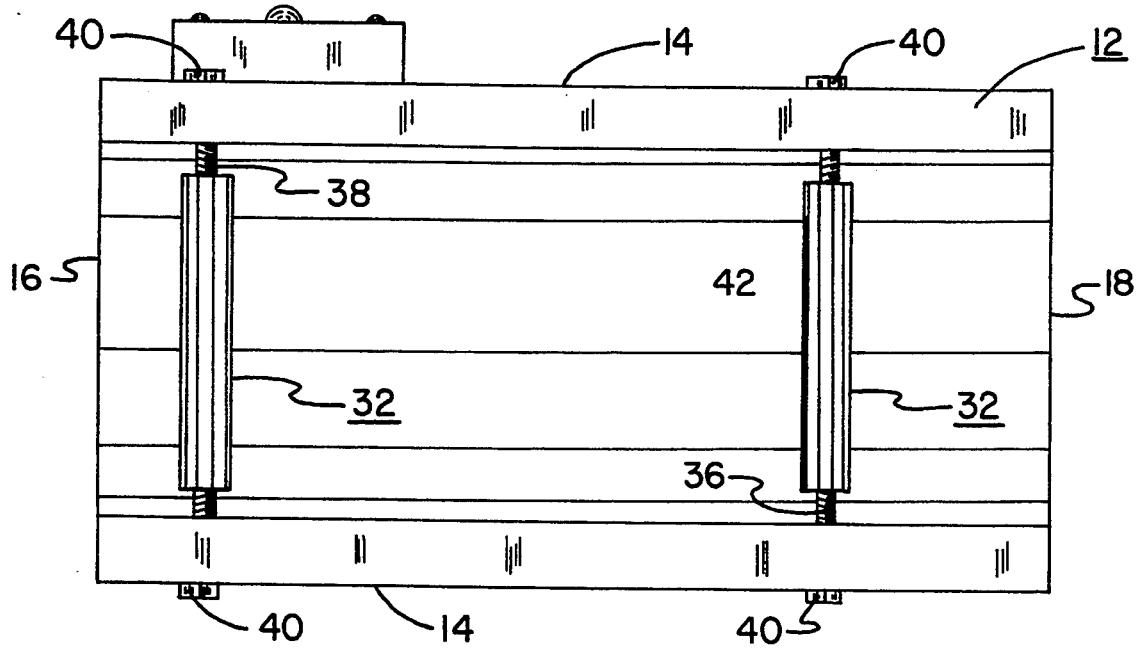
FIG. 4 is a bottom plan view of the rubber mailbox jacket in the operative orientation.
Figure 5:
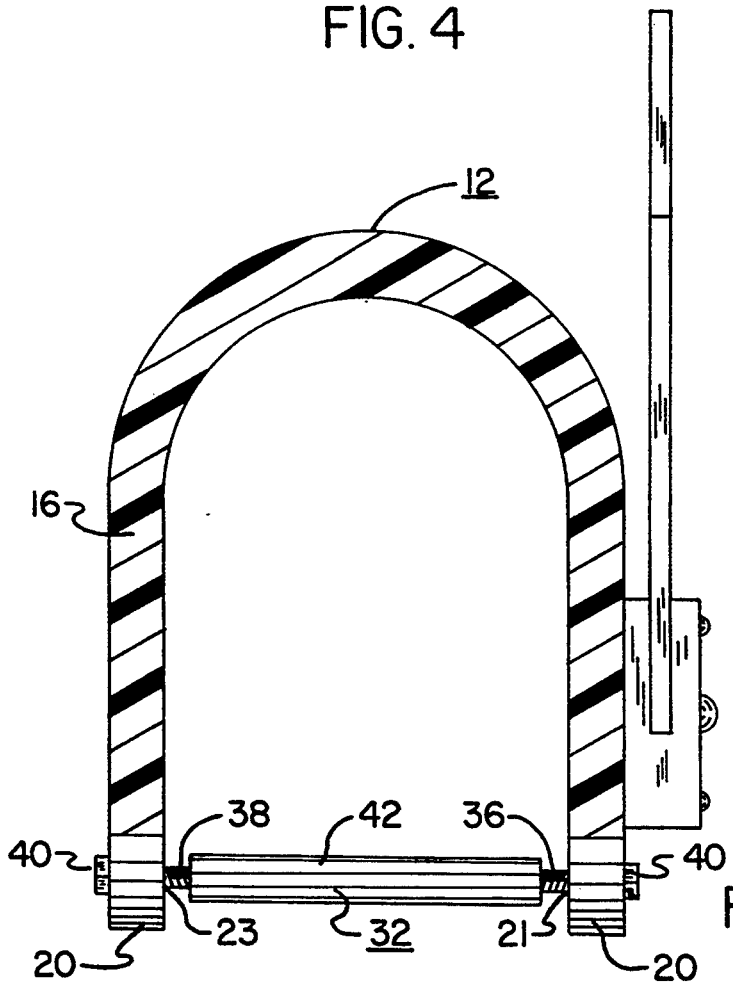
FIG. 5 is a front perspective view of the rubber mailbox jacket in the operative orientation.

Specifically, it will be noted in FIGS. 1 through 6, that there is provided a new and improved rubber mailbox jacket. The rubber mailbox jacket 10, in its broadest context, comprises a cover 12 and two coupling devices 32.

More specifically, the cover 12 is fabricated of rubber and is formed in a generally planar rectangular configuration with parallel long side edges 14 and a parallel front 16 and rear edge 18. The rubber utilized in the apparatus is thick and durable. Each long side edge 14 includes two generally semi-circular shaped projections 20, 22 with holes 21, 23 which extend therethrough. A first projection 20 is positioned a short distance from each front edge 16. A second projection 22 is positioned equidistantly between each rear edge 18 and the approximate midpoint of each long side edge. The projections extend a short distance from the edge. Note FIGS. 1 and 3.

Three screw holes 24, 26, 28 are positioned adjacent to the first semi-circular projection 20 on one of the long side edges 14 of the cover. The first screw hole 24 is positioned a short distance from the first projection 20. The first screw hole is located approximately directly above the aperture in the first projection. The second screw hole 26 is positioned rearwardly with respect to the first screw hole 24 in a direction parallel to the plane of the long side edge. The third screw hole 28 is positioned closer to the opposite long side edge, with respect to the first screw hole 24, in a direction parallel to the plane of the front edge 16. The screw holes permits the affixation of a mailbox flag thereupon. The triangular configuration permits vertical and horizontal movement of the flag in a rearward direction. Note FIGS. 1 and 3.

In the inoperative orientation the cover lies in a flat planar configuration. In the operative orientation the cover is contoured to fit snugly around the exterior of a generally semi-spherical shaped mailbox. The projections 20, 22 on the long side edges of the cover are positioned beneath the bottom of a mailbox opposing each other in the operative orientation. The projections are positioned vertically in the operative orientation. The screw holes 24, 26, 28 in the cover are adapted to permit the positioning of a mailbox flag thereupon. The coupling screws of the flag are positioned through the holes and into the mailbox. The rubber cover 12 is adapted to protect the mailbox from vandalism and harsh weather conditions. The sturdy rubber cover absorbs the brunt of a vandal's assault. The rubber is also adapted to withstand a wide variety of weather conditions. Note FIGS. 1, 2 and 3.

Two coupling devices 32 each consist of two bolts 34 and a connection rod 36. Each bolt is formed in a long solid, generally cylindrical configuration with a plurality of external screw threads 38 throughout its extent.

Each bolt has a planar, generally hexagon shaped head 40 at one of its ends. The bolts are made of sturdy materials and the hexagon shaped head allows easy turning of the bolts. Note FIGS. 3, 4 and 5.

Each connection rod 42 is formed in a long, generally cylindrical configuration with a larger outer diameter than the bolts. The axis of the connection rod includes an aperture 44 which extends its entire length. The aperture includes a plurality of internal screw threads 46. The rod is positioned horizontally beneath a mailbox in the operative orientation. Note FIGS. 4 and 6.

In the operative orientation each bolt is positioned through one of the holes in the semi-circular projections of the cover with each screw head extending outwardly. The free ends of the opposing pairs of bolts are adapted to screw into the connecting rod in the operative orientation. The coupling devices are positioned beneath the bottom of the mailbox and are adapted to tightly secure the cover therearound. The further the bolts penetrate the connection rod, the tighter the fit of the cover. Note FIGS. 4 and 5.

Everyone who owns a rural mailbox knows that they do not last as long as one would think. They are subject to all types of abuse such as cars sliding into them, wear and tear from being outside all of the time, and especially from vandalism.

Unfortunately, many people love doing damage to nearby mailboxes. There is even a game called "mailbox baseball" in which the participants drive by a row of mailboxes while one person leans out of a car window and tries to hit them with a baseball bat. The result is that many people are forced to replace their mailbox every couple of years or so. This involves not only the extra expense to purchase the mailbox, but also the time to install it or paying someone else to do so.

The rubber mailbox jacket will not completely eliminate such practices, but it will make mailboxes more resistant to the punishment that vandals dish out. This product consists of a rubber sleeve that fits snugly over the mailbox. The jacket is secured to the bottom of the mailbox by nuts and bolts. The rubber helps to prevent denting from blows by vandals, wayward cars, etc.

The product does not interfere in any way with opening and closing of the mailbox door. In addition, it can be made in a variety of sizes to fit large and small mailboxes. For anyone who would like that extra protection for their mailbox, this product has a lot to offer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved mail box jacket comprising, in combination:

a cover fabricated of rubber and formed in a generally planar rectangular configuration with parallel long side edges and a parallel front and rear edge, each long side edge including two generally semi-circular shaped projections with holes extending therethrough, a first projection is positioned a short distance from each front edge, a second projection is positioned equidistantly between each rear edge and the approximate midpoint of each long side edge, three screw holes being positioned adjacent to the first semi-circular projection on one of the long side edges of the cover, the first screw hole being positioned a short distance from the first projection, the second screw hole being positioned rearwardly with respect to the first screw hole in a direction parallel to the plane of the long side edge, the third screw hole being positioned closer to the opposite long side edge with respect to the first screw hole, in a direction parallel to the plane of the front edge, in the inoperative orientation the cover lying in a flat planar configuration, in the operative orientation the cover being contoured to fit snugly around the exterior of a generally semi-spherical shaped mailbox, the projections on the long side edges of the cover being positioned beneath the bottom of a mailbox opposing each other in the operative orientation, the screw holes in the cover adapted to permit the positioning of a mailbox flag thereupon, the coupling screws of the flag being positioned through the holes and into the mailbox, the rubber cover adapted to protect the mailbox from vandalism and harsh weather conditions; and two coupling devices, each device consisting of two bolts and a connection rod, each bolt formed in a long solid generally cylindrical configuration with a plurality of external screw threads throughout its extent, each bolt having a planar generally hexagon shaped head at one of its ends, each connection rod formed in a long generally cylindrical configuration with a larger outer diameter than the bolts, the axis of the connection rod including an aperture extending its entire length, the aperture including a plurality of internal screw threads, in the operative orientation each bolt being positioned through one of the holes in the semi-circular projections of the cover with each screw head extending outwardly, the free ends of the opposing pairs of bolts adapted to screw into the connecting rod in the operative orientation, the coupling devices being positioned beneath the bottom of the mailbox and adapted to tightly secure the cover therearound.

2. A mail box jacket comprising:

a cover fabricated of rubber and formed in a generally planar rectangular configuration with parallel long side edges and parallel front and rear edges, the cover including coupling devices positioned upon the long side edges of the cover, in the inoperative orientation the cover lying in a flat planar configuration, in the operative orientation the cover being contoured to fit snugly around the exterior of a mailbox; and the coupling devices of the cover consisting of generally semi circular shaped projections with holes extending therethrough, a first projection being positioned on each long side edge near the front edge and a second projection being positioned on each long side edge near the rear edge, the projections on the long side edges of the cover being positioned beneath the bottom of a mailbox opposing each other in the operative orientation.

3. The apparatus as set forth in claim 2 wherein the cover includes a plurality of screw holes, the holes being positioned adjacent to the first semi-circular projection on one of the long side edges of the cover, the screw holes in the cover adapted to permit the positioning of a mailbox flag thereupon, the coupling screws of the flag being positioned through the holes and into the mailbox.

4. The apparatus as set forth in claim 2 and further including:

two coupling devices each consisting of two bolts and a connection rod, each bolt formed in a long solid cylindrical configuration with a plurality of external screw and a planar head, each connection rod formed in a long generally cylindrical configuration with a larger outer diameter than the bolts, the axis of the connection rod including an aperture with a plurality of internal screw threads, in the operative orientation each bolt being positioned through one of the holes in the semi-circular projections of the cover with each screw head extending outwardly, the free ends of the opposing pairs of bolts adapted to screw into the connecting rod thereby tightly securing the cover therearound.

* * * * *